US007105732B1

(12) United States Patent
Hsieh

(10) Patent No.: US 7,105,732 B1
(45) Date of Patent: Sep. 12, 2006

(54) MUSICAL INSTRUMENT STAND WITH A SELF-LOCKING NECK LOCK ASSEMBLY

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 29 days.

(21) Appl. No.: 11/088,458

(22) Filed: Mar. 24, 2005

(51) Int. Cl.
*G10D 3/00* (2006.01)

(52) U.S. Cl. ..... 84/327

(58) Field of Classification Search ..... 84/421, 84/327, 329, 453; 248/453
See application file for complete search history.

(56) References Cited

U.S. PATENT DOCUMENTS 6,559,365 B1 * 5/2003 Wilfer ..... 84/327
6,835,883 B1 * 12/2004 Stevens ..... 84/453
* cited by examiner

*Primary Examiner*—Kimberly Lockett
(74) *Attorney, Agent, or Firm*—Jackson Walker, LLP

(57) ABSTRACT

A musical instrument stand with a self-locking neck lock assembly for a guitar-shaped musical instrument has a post, multiple legs and a self-locking neck lock assembly. The self-locking neck lock assembly is attached to the post and has a stationary bracket, two locking palms, a movable bracket and a spring. The stationary bracket is attached securely to the post and has a U-shaped stationary collar having two distal ends. The locking palms are rotatably mounted on respectively the distal ends. The movable bracket is mounted pivotally on the stationary bracket and has a U-shaped movable collar. The movable collar has two distal ends mounted slidably to the palms to open or close the palms. The spring is mounted between the stationary and movable brackets and biases the movable collar upward to open the palms. When the movable bracket pivots down, the locking palms pivot to lock the neck.

4 Claims, 8 Drawing Sheets

MUSICAL INSTRUMENT STAND WITH A SELF-LOCKING NECK LOCK ASSEMBLY

BACKGROUND OF THE INVENTION

1. Field of the Invention

The present invention relates to a musical instrument stand, and more particularly to a musical instrument stand with a self-locking neck lock assembly.

2. Description of Related Art

Conventional musical instrument stands are available to hold musical instruments such as guitars upright for display or maintenance. A guitar-shaped musical instrument has a body, a neck and a head. Therefore, a stand for a guitar-shaped musical instrument generally has a neck lock to hold the neck and the head of the musical instrument.

With reference to FIGS. 6 and 7, a conventional neck lock for a guitar-shaped musical instrument is attached to a stand with a top end and comprises a base and a neck retainer.

The base is mounted on the top end of the stand and has a mounting sleeve (70), a shaft (72), a crossbar (75), a connector (71) and two pivot arms (73, 74).

The mounting sleeve (70) is attached securely to the stand and has a front end. The shaft (72) is mounted in the front end of the mounting sleeve (70) and has a front end. With further reference to FIGS. 8 and 9, the crossbar (75) is mounted transversely on the front end of the shaft (72) and has two ends and two slots (750). The slots (750) are defined through the crossbar (75) close respectively to the ends. The connector (71) is hollow, is mounted securely around the mounting sleeve (70) and has an open front. The pivot arms (73, 74) are mounted pivotally in the connector (71) and extend through the open front, and each has a front end.

The neck retainer is attached movably to the base and has a neck rest (80), a spring, two drive rods (82), two L-shaped drivers (84) and two locking palms (83).

The neck rest (80) is hollow, is attached pivotally to the front ends of the pivot arms (73, 74), abuts the open front of the connector (71) and has a top inner surface, a bottom inner surface, a front and two arms (801). The arms (801) are tubular and are attached to the front of the neck rest (80) to hold a guitar-shaped musical instrument. The drive rods (82) rotatably extend respectively through the arms (801), and each has a rear end and a front end. The L-shaped drivers (84) rotatably extend respectively through the slots (750) in the crossbar (75) and are securely mounted respectively through the drive rods (82) near the rear ends. The locking palms (83) are perpendicularly attached respectively to the front ends of the drive rods (82). The spring is mounted between the top inner surface of the neck rest (80) and the shaft (72) and presses the neck rest (80) up to an open position so the locking palms (83) point down when no external force is applied to the arms (801).

A guitar to be mounted on a conventional musical instrument stand with a neck lock has a weight, a body, a neck and a head. The neck is attached to the body and has a distal end. The head is attached to the distal end of the neck.

The guitar is mounted on the stand by placing the neck between the arms (801) and resting the head on the arms (801). The weight of the guitar pulls the neck rest (80) and the drive rods (82) down relative to the connector (71). The L-shaped drivers (84) rotated the drive rods (82) as they slide in the slots (750) in the crossbar (75). The locking palms (83) rotate to face each other and hold the neck of the guitar between the arms (801).

However, the structure of the conventional neck lock is complex, is hard to assemble and is expensive.

To overcome the shortcomings, the present invention provides a musical instrument stand with a self-locking neck lock assembly to mitigate or obviate the aforementioned problems.

SUMMARY OF THE INVENTION

The main objective of the invention is to provide a musical instrument stand with a self-locking neck lock assembly for a guitar-shaped musical instrument.

A musical instrument stand with a self-locking neck lock assembly in accordance with the present invention comprises a post, multiple legs and a self-locking neck lock assembly.

The self-locking neck lock assembly is mounted on the post and has a stationary bracket, two locking palms, a movable bracket and a spring.

The stationary bracket is attached securely to the post and has a stationary collar having two ends.

The locking palms are rotatably attached respectively to the ends of the stationary collar.

The movable bracket is attached pivotally the stationary bracket and has a movable collar. The movable collar has two ends slidably connecting respectively to the palms.

The spring is mounted between the stationary and movable brackets and biases the movable collar to an unloaded position above the stationary collar where the locking palms are in an open position.

Other objectives, advantages and novel features of the invention will become more apparent from the following detailed description when taken in conjunction with the accompanying drawings.

DETAILED DESCRIPTION OF PREFERRED EMBODIMENT

Figure 1:
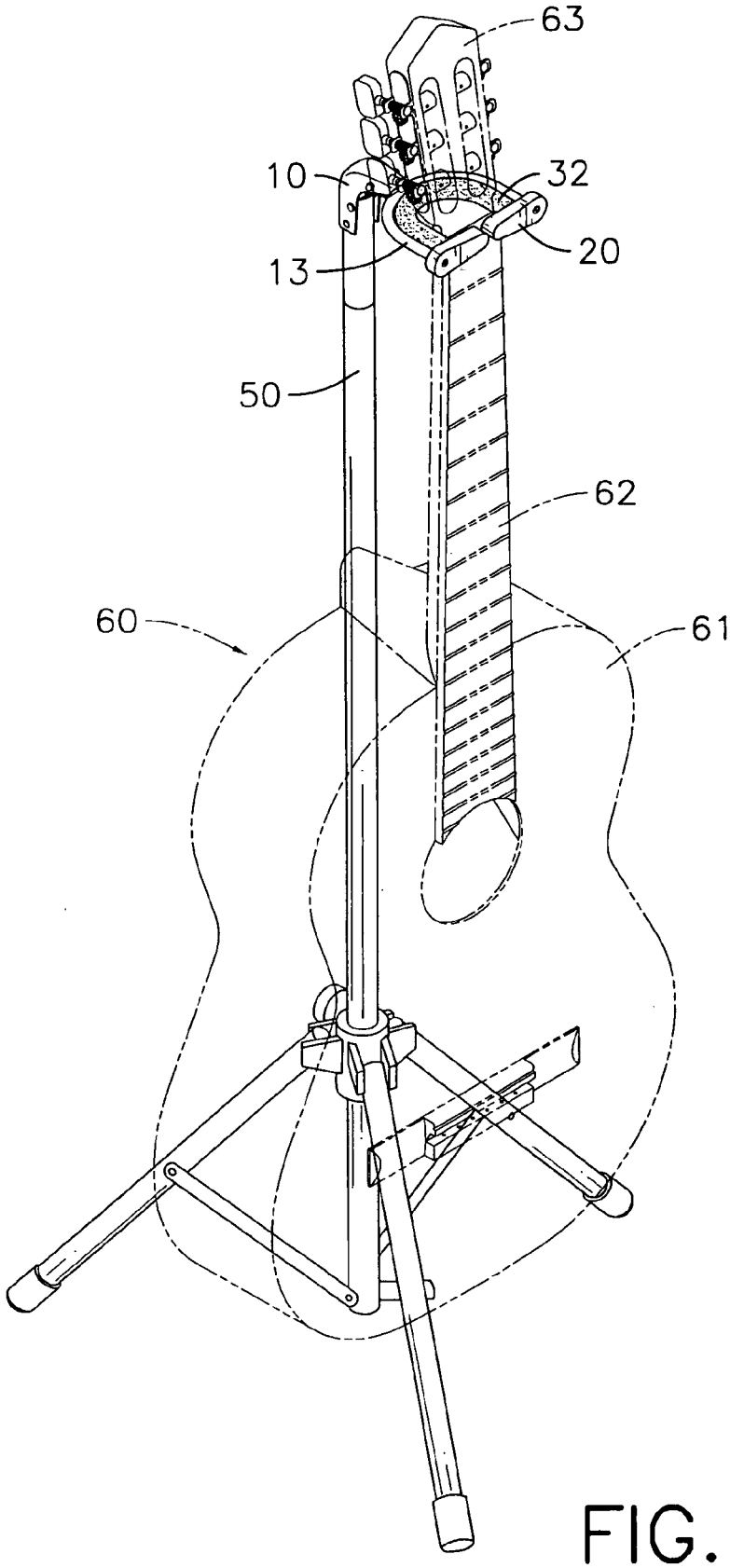
FIG. 1 is a perspective view of a musical instrument stand with a self-locking neck lock assembly with a guitar.

With reference to FIG. 1, a musical instrument stand with a self-locking neck lock assembly in accordance with the present invention holds a guitar-shaped musical instrument (60) upright. The guitar-shaped musical instrument (60) has a weight, a body (61), a neck (62) and a head (63). The neck (62) is attached to the body (61) and has a top end. The head (63) is attached to the top end of the neck (62).

The musical instrument stand comprises a post (50), multiple legs and a self-locking neck lock assembly.

The post (50) has a top end and a bottom end.

The legs are attached to the post (50) close to the bottom end and extend radially out from the post (50).

Figure 2:
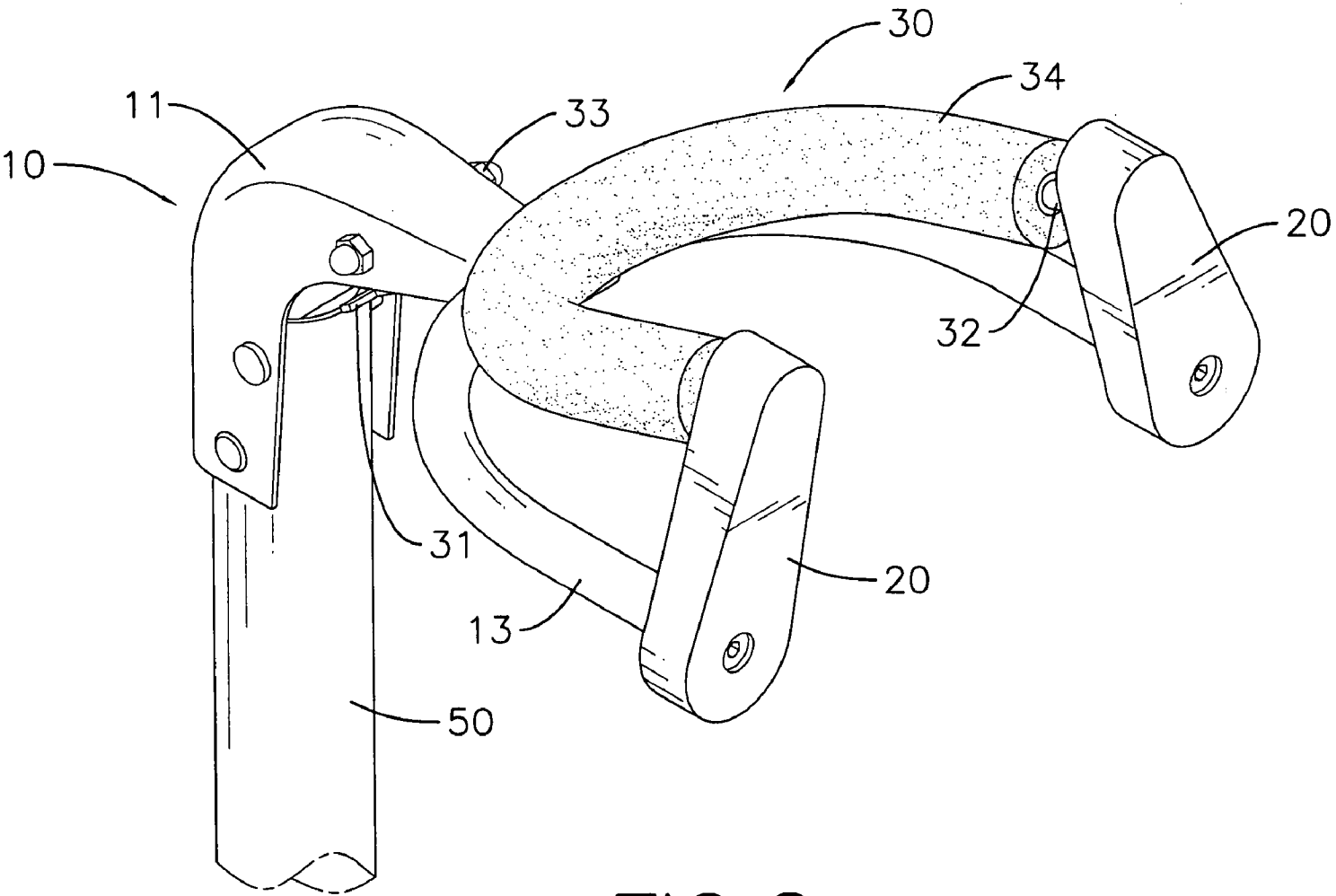
FIG. 2 is an enlarged perspective view of the self-locking neck lock assembly in FIG. 1.
Figure 3:
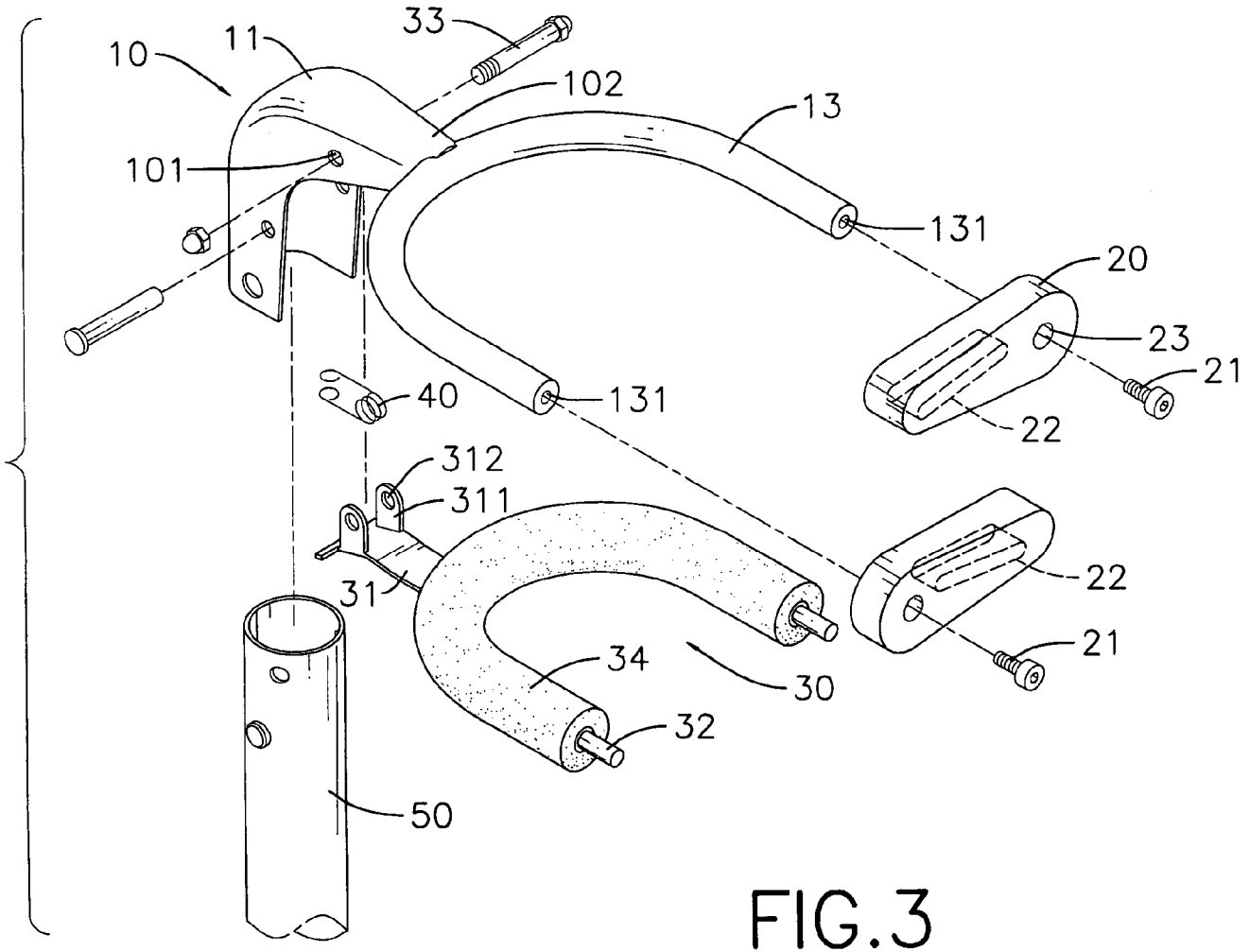
FIG. 3 is an exploded perspective view of the self-locking neck lock assembly in FIG. 2.

With further reference to FIGS. 2 and 3, the self-locking neck lock assembly is attached securely to the top end of the post (50) and has a stationary bracket (10), two locking palms (20), a movable bracket (30) and a spring (40).

The stationary bracket (10) is attached securely the top end of the post (50) and has a mounting bracket (11) and a stationary collar (13).

The mounting bracket (11) is hollow, is attached securely to the top end of the post (50) and has two sidewalls, a longitudinal leg and a transverse arm. A preferred embodiment of the mounting bracket (11) further has two pivot holes (101). The longitudinal leg is attached securely to the top end of the post (50) and has a top end. The transverse arm is formed on and extends perpendicularly from the top end of the longitudinal leg and has a distal end (102). The pivot holes (101) are defined respectively through the sidewalls and are aligned with each other.

The stationary collar (13) is U-shaped, is formed on the distal end (102) of the transverse arm of the mounting bracket (11) and has two distal ends and a gap. The preferred embodiment of the stationary collar (13) further has two threaded holes (131). The distal ends are separated by a distance, and the gap is defined between the distal ends. The threaded holes (131) are axially defined respectively in the distal ends of the stationary collar (13).

The locking palms (20) are pivotally attached perpendicularly respectively to the distal ends of the stationary collar (13). Each locking palm (20) has an inner surface, a proximal end, a distal end, a length, a slot (22), a through hole (23) and a fastener (21). The length of the locking palm (20) is shorter than half the distance between the distal ends of the stationary collar (13). The slot (22) is defined longitudinally in the inner surface close to the distal end of the locking palm (20) and faces the stationary collar (13). The through hole (23) is defined close to the proximal end of the locking palm (20) and corresponds to one of the distal ends of the stationary collar (13). The fastener (21) extends through the through hole (23) in the locking palm (20) and rotatably holds the locking palm (20) on the distal end of the stationary collar (13). A preferred embodiment of the fastener (21) is a bolt. The bolt screws into a corresponding threaded hole (131) in a distal end of the stationary collar (13).

The movable bracket (30) is attached pivotally to the stationary bracket (10) and has a pivot bracket (31), a movable collar (32) and a cover (34). A preferred embodiment of the movable bracket (30) also has a pivot pin (33).

The pivot bracket (31) is mounted pivotally between the sidewalls of the mounting bracket (11) in the transverse arm and has two side edges, a rear end, a front end, a top and two connectors. A preferred embodiment of the connectors is two wings (311) formed on and extending perpendicularly from the top respectively on the side edges close to the rear end of the pivot bracket (31) and mounted pivotally between the sidewalls of the mounting bracket (11) in the transverse arm. Each wing (311) has a pivot hole (312) defined through the wing (311) and corresponding to and aligning with one of the pivot holes (101) in the mounting bracket (11).

The pivot pin (33) extends through the pivot holes (101) in the mounting bracket (11) and the pivot holes (312) in the pivot bracket (31) to allow the pivot bracket (31) to pivot on the mounting bracket (11).

The movable collar (32) is U-shaped, is formed on the front end of the pivot bracket (31) and has two distal ends and a gap. The movable collar (32) is narrower than the stationary collar (13). The distal ends of the movable collar (32) are slidably mounted respectively in the slots (22) in the locking palms (20). The gap is defined between the distal ends of the movable collar (32).

The cover (34) is made of resilient material such as foam rubber, padded material or the like and is mounted around the movable collar (32) to cushion the head of the musical instrument and keep it from slipping or being damaged.

Figure 4:
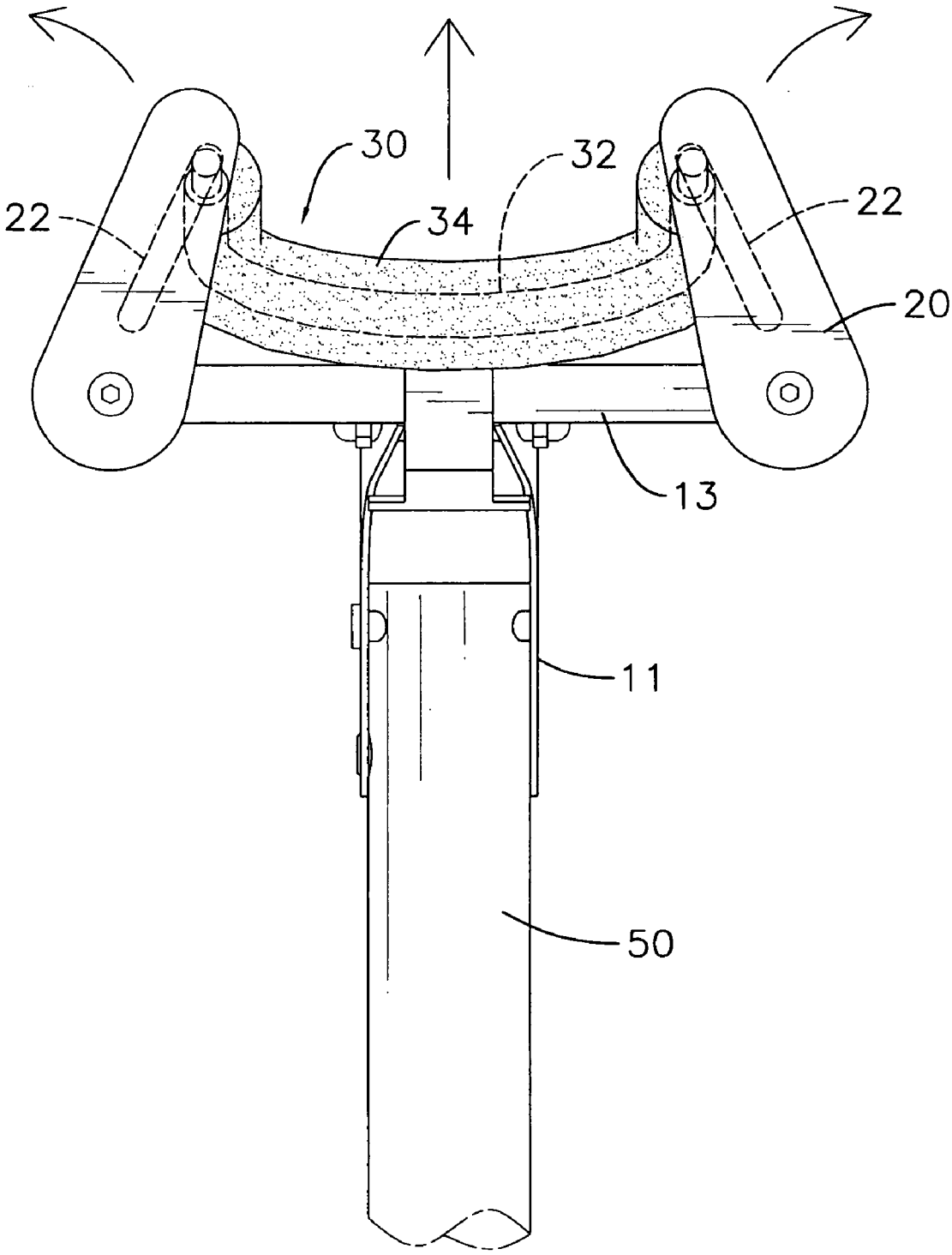
FIG. 4 is an operational front view of the self-locking neck lock assembly in FIG. 2 with the locking palms open.

With further reference to FIG. 4, the spring (40) is mounted inside the mounting bracket (11) and presses against the pivot bracket (31) to move the movable bracket (30) upward and open the locking palms (20). In a preferred embodiment, the spring (40) is mounted around the pivot pin (33) and presses against the rear end of the pivot bracket (31) and the transverse arm or the longitudinal leg of the mounting bracket (11).

Figure 5:
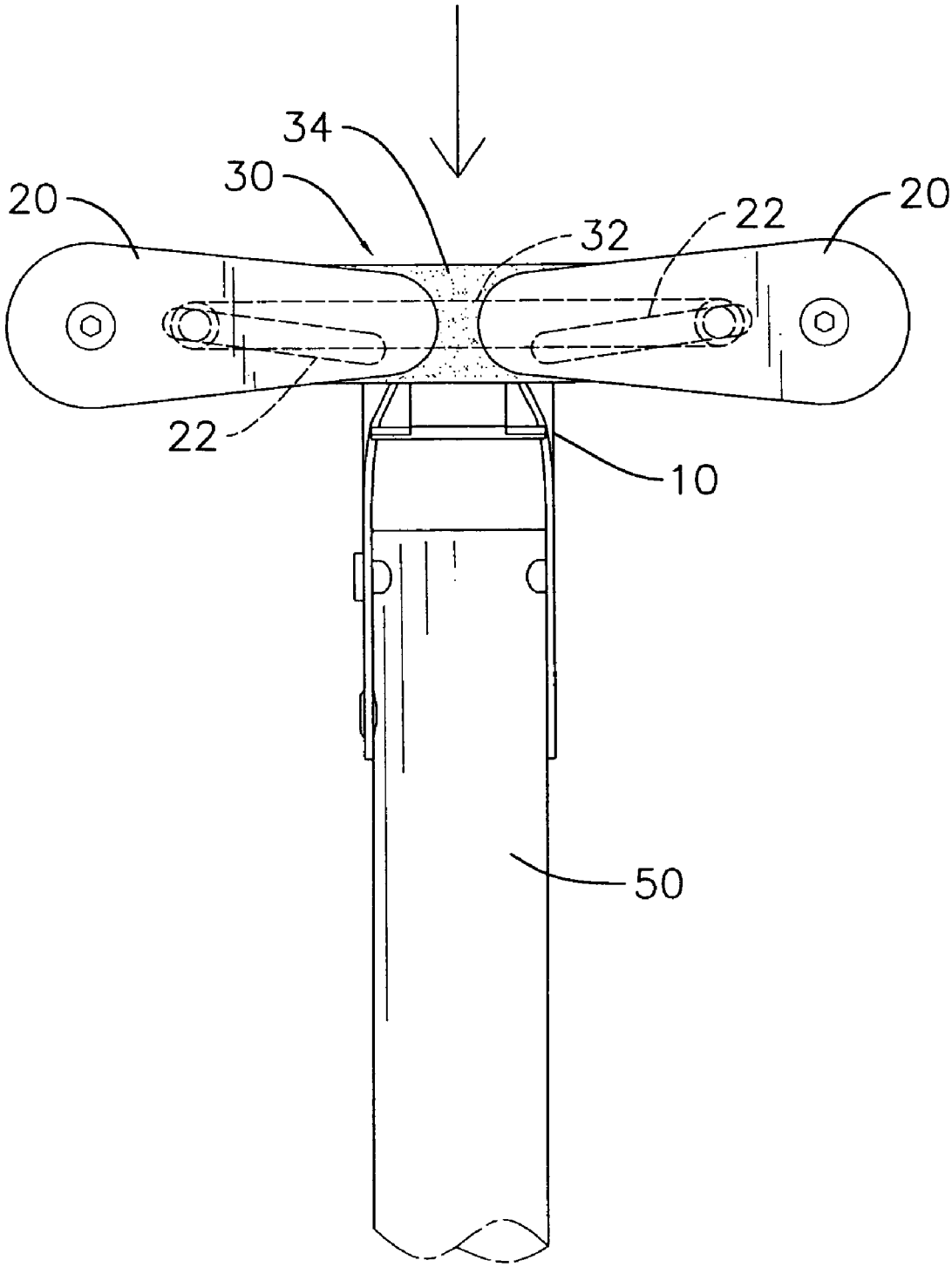
FIG. 5 is an operational front view of the self-locking neck lock assembly in FIG. 2 with the locking palms closed.
Figure 6:
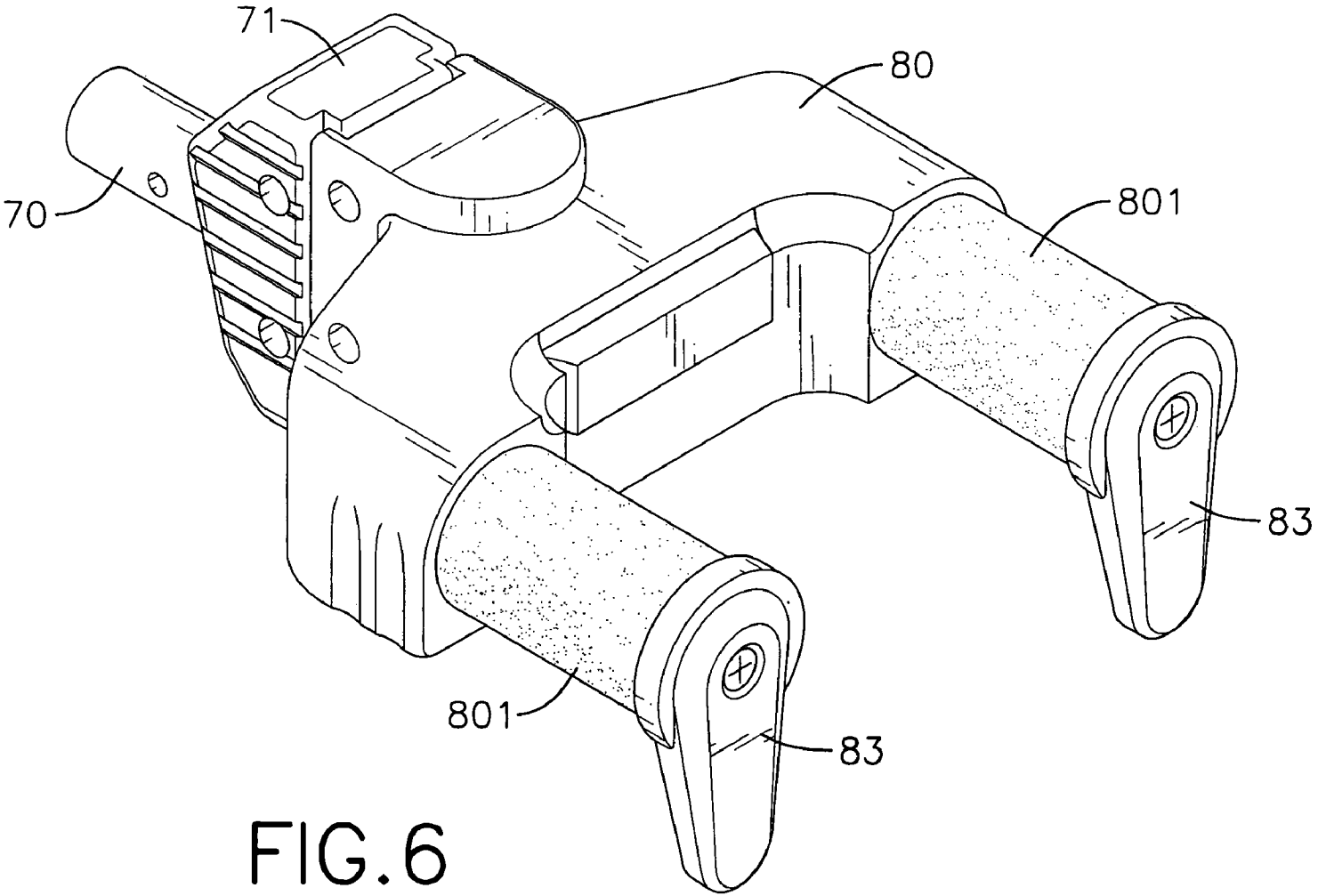
FIG. 6 PRIOR ART
FIG. 6 is a perspective view of a conventional self-locking neck lock assembly in accordance with the prior art.
Figure 7:
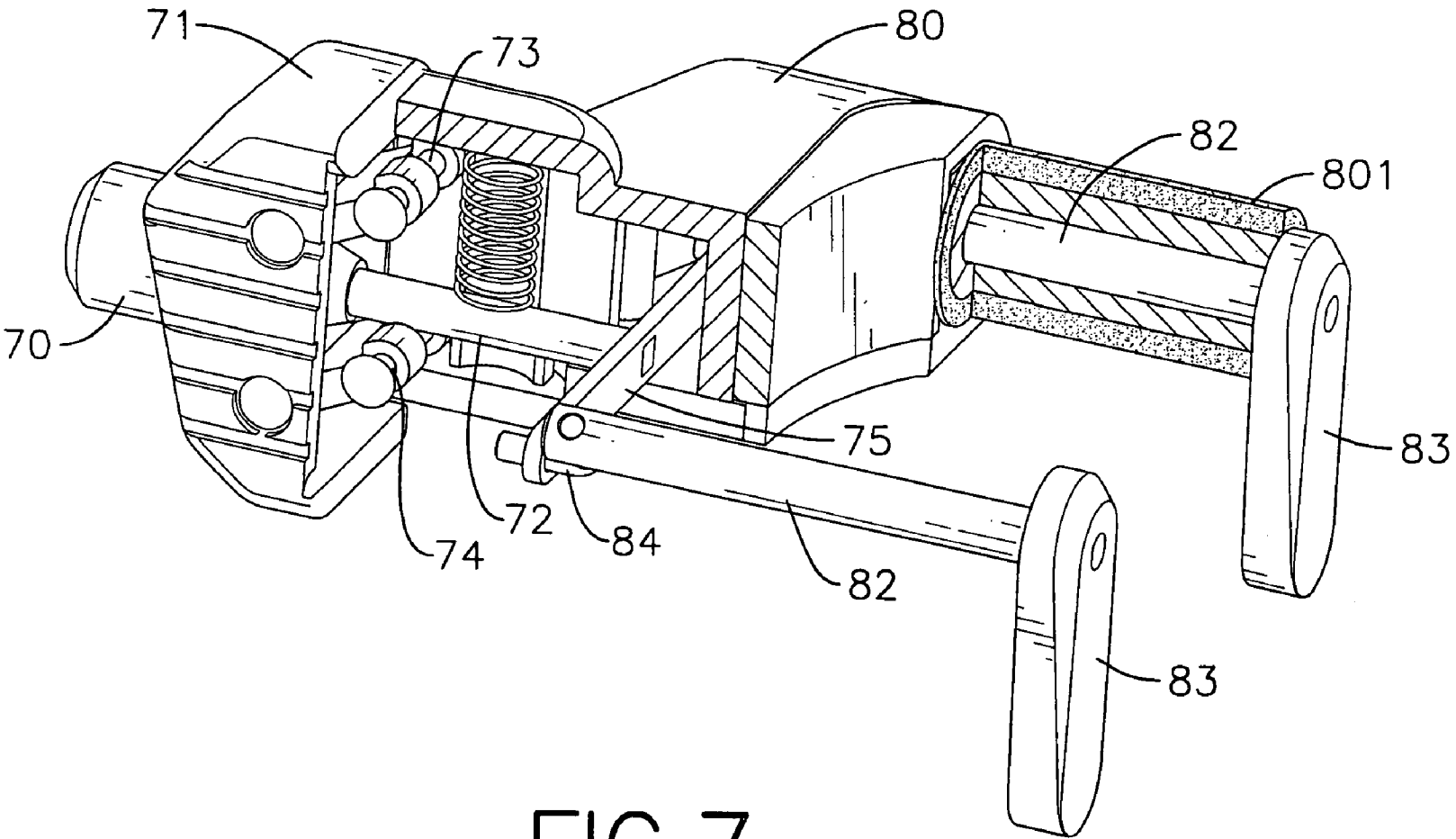
FIG. 7 PRIOR ART
FIG. 7 is a perspective view in partial section of the neck lock in FIG. 6.
Figure 8:
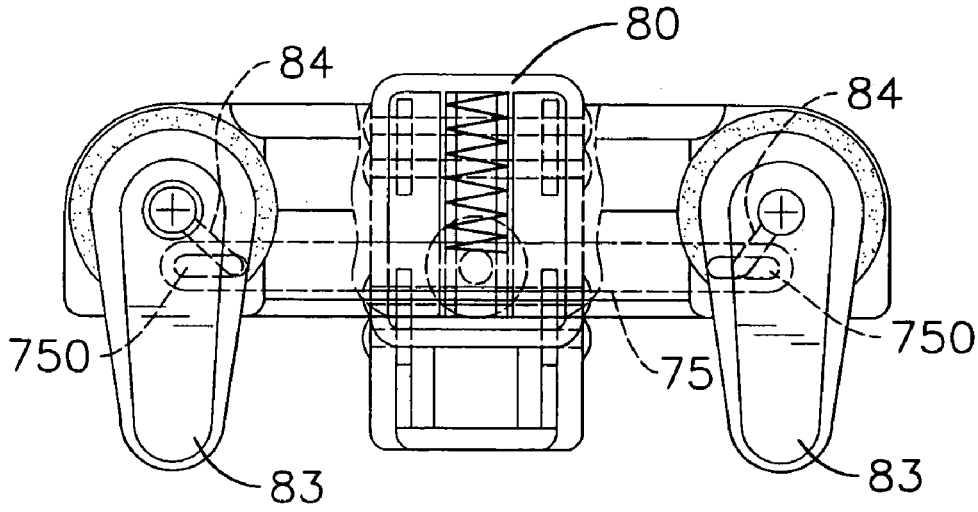
FIG.8 PRIOR ART
FIG. 8 is an operational front view of the neck lock in FIG. 6 with the locking palms open.
Figure 9:
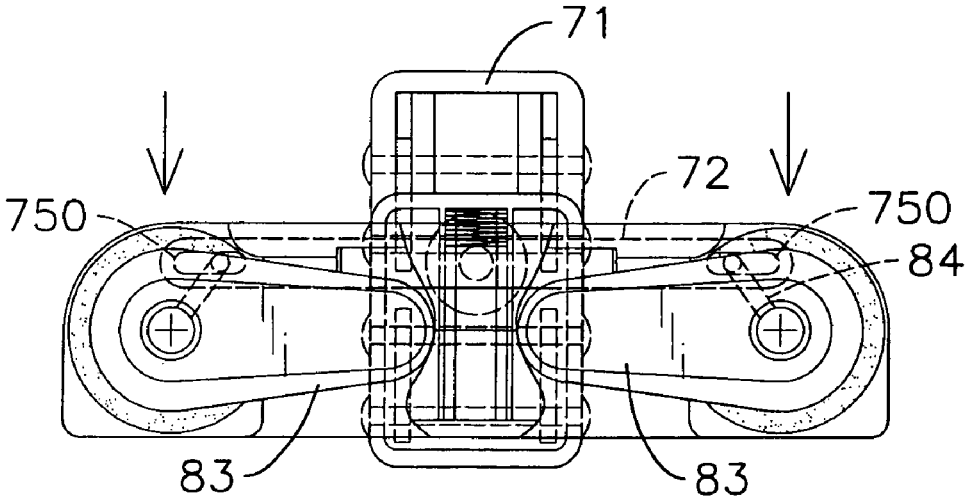
FIG.9 PRIOR ART
FIG. 9 is an operational front view of the neck lock in FIG. 6 with the locking palms closed.

With further reference to FIG. 5, the musical instrument stand with a self-locking neck lock assembly holds a guitar-shaped musical instrument (60) upright by inserting the neck (63) between the locking palms (20) and through the gaps in the stationary and movable collars (13, 32) and setting the head (63) on the movable collar (32). The weight of the guitar-shaped musical instrument (60) pivots the movable collar (32) down. The distal ends of the movable collar (32) slide in the slots (22) in the locking palms (20) and pivot the locking palms (20) down until the distal ends of the locking palms (20) face each other and close the gaps in the stationary and movable collars (13, 32). The guitar-shaped musical instrument (60) is securely held upright on the stand.

The self-locking neck lock assembly has a simple structure and a low cost relative to a conventional self-locking neck lock.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A musical instrument stand for a guitar-shaped musical instrument comprising:

a post having a top end and a bottom end;

multiple legs attached to the post close to the bottom end and extending radially out from the post; and a self-locking neck lock assembly attached securely to the top end of the post and having a stationary bracket attached securely to the top end of the post and: having a mounting bracket being hollow, attached securely to the top end of the post and having two sidewalls;

a longitudinal leg attached securely to the top end of the post and having a top end; and a transverse arm formed on and extending perpendicularly from the top end of the longitudinal leg and having a distal end; and a stationary collar being U-shaped, formed on the distal end of the longitudinal leg and having two distal ends separated by a distance; and a gap defined between the distal ends of the stationary collar;

two locking palms pivotally attached perpendicularly respectively to the distal end of the stationary collar, and each locking palm having an inner surface;

a proximal end;

a distal end;

a length shorter than half the distance between the distal ends of the stationary collar;

a slot defined longitudinally in the inner surface close to the distal end of the locking palm and facing the stationary collar;

a through hole defined close to the proximal end of the locking palm and corresponding to one of the distal ends of the stationary collar; and a fastener passing through the through hole in the locking palm and rotatably holding the locking palm on the distal end of the stationary collar;

a movable bracket attached pivotally to the stationary bracket and having a pivot bracket mounted pivotally between the sidewalls of the mounting bracket in the transverse arm and having two side edges, a rear end, a front end, a top and two connectors; and a movable collar being U-shaped and narrower than the stationary collar, formed on the front end of the pivot bracket and having two distal ends slidably mounted respectively in the slots in the locking palms; and a gap defined between the distal ends of the movable collar; and a spring mounted inside the mounting bracket and pressing against the pivot bracket to move the movable bracket upward and open the locking palms.

2. The stand as claimed in claim 1, wherein the movable bracket further comprises a cover made of resilient material and mounted around the movable collar.

3. The stand as claimed in claim 1, wherein:

the mounting bracket further has two pivot holes respectively defined through the sidewalls and are aligned with each other;

the connectors on the pivot bracket of the movable bracket are two wings extending perpendicularly from the top respectively on the side edges close to the rear end of the pivot bracket and mounted pivotally between the sidewalls of the mounting bracket in the transverse arm, and each wing has a pivot hole defined through the wings and corresponding to the one of the pivot holes in the mounting bracket;

the movable bracket further has a pivot pin extending through the pivot holes in the mounting bracket and the pivot holes in the pivot bracket; and the spring is mounted around the pivot pin.

4. The stand as claimed in claim 1, wherein:

the stationary collar of the stationary bracket has two threaded holes defined respectively in the distal ends of the stationary collar; and the fastener in each locking palm is a bolt that screws into a corresponding threaded hole in a distal end of the stationary collar.

* * * * *

UNITED STATES PATENT AND TRADEMARK OFFICE

CERTIFICATE OF CORRECTION

PATENT NO. : 7,105,732 B1
APPLICATION NO. : 11/088458
DATED : September 12, 2006
INVENTOR(S) : Wu-Hong Hsieh It is certified that error appears in the above-identified patent and that said Letters Patent is hereby corrected as shown below:

Column 5, line 6 “longitudinal leg” should read -- transverse arm --.

Signed and Sealed this
Eighth Day of March, 2011

David J. Kappos

David J. Kappos
*Director of the United States Patent and Trademark Office*